US005422957A

United States Patent [19]

Cummins

[11] Patent Number: 5,422,957

[45] Date of Patent: Jun. 6, 1995

[54] CABLE TAKE-UP FOR EARPHONES

[76] Inventor: Robert C. Cummins, 6011 N. Panorama Dr., Tucson, Ariz. 85743

[21] Appl. No.: 181,821

[22] Filed: Jan. 18, 1994

[51] Int. Cl.[6] ..... H04R 25/00

[52] U.S. Cl. ..... 381/183; 381/187; 439/501

[58] Field of Search ..... 242/107.6; 181/129, 181/130, 135; 379/438, 430; 381/183, 187, 25; 455/351; 439/12, 13, 18, 20, 22, 24, 27, 501

[56] References Cited

U.S. PATENT DOCUMENTS

| | | | |
|---|---|---|---|
| 2,172,043 | 9/1939 | Wolf | 242/107.6 |
| 4,942,617 | 7/1990 | Boylan | 381/187 |
| 4,989,805 | 2/1991 | Burke | 242/107.1 |
| 5,236,371 | 8/1993 | Matthis | 439/501 |
| 5,339,461 | 8/1994 | Luplow | 455/351 |

FOREIGN PATENT DOCUMENTS

| | | | |
|---|---|---|---|
| 0451310 | 9/1949 | Italy | 242/107.6 |

*Primary Examiner*—Curtis Kuntz
*Assistant Examiner*—Huyen D. Le
*Attorney, Agent, or Firm*—Cahill, Sutton & Thomas

[57] ABSTRACT

A cable take-up includes a cylindrical case and a plug mechanically attached to the case and extending axially from the case. Within the case, a cable is wound onto a rotating spool biased by a spring to retract the cable. A ratchet prevents the cable from retracting and a release for the ratchet is accessible from outside of the case. The cable preferably is a flat ribbon of Kevlar ® plastic having several wires embedded therein. One end of the cable is connected to earpieces and the other end of the cable is connected to the plug through a commutator. The commutator includes a first disk having resilient, conductive contacts attached to the plug and a second, rotating disk having concentric, conductive stripes attached to the cable and rubbing on the conductive contacts.

5 Claims, 1 Drawing Sheet

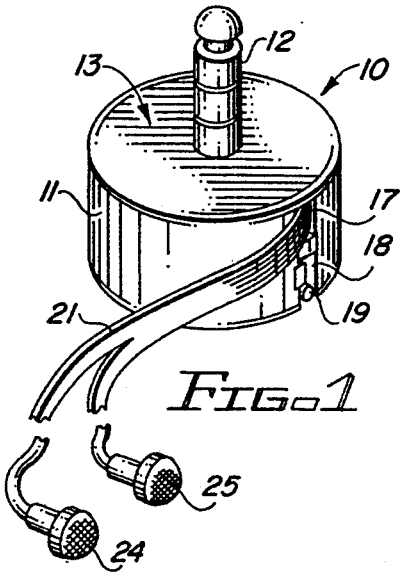
FIG. 1
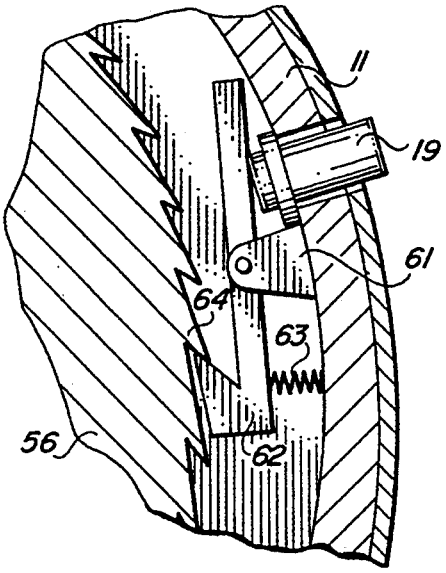
FIG. 4
FIG. 3
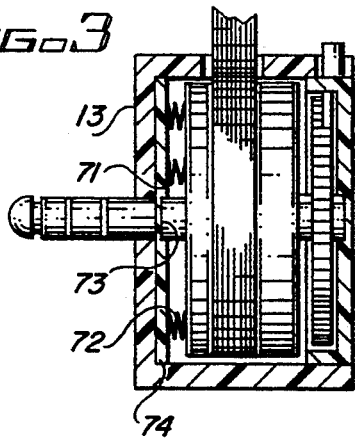
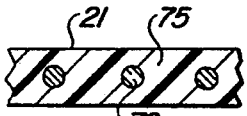
FIG. 6
FIG. 5
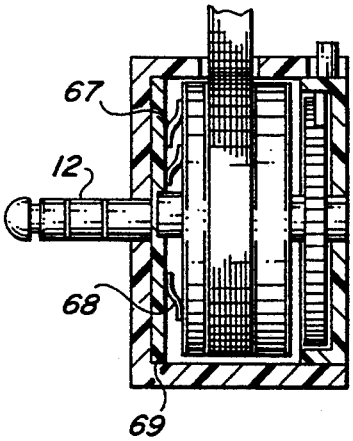
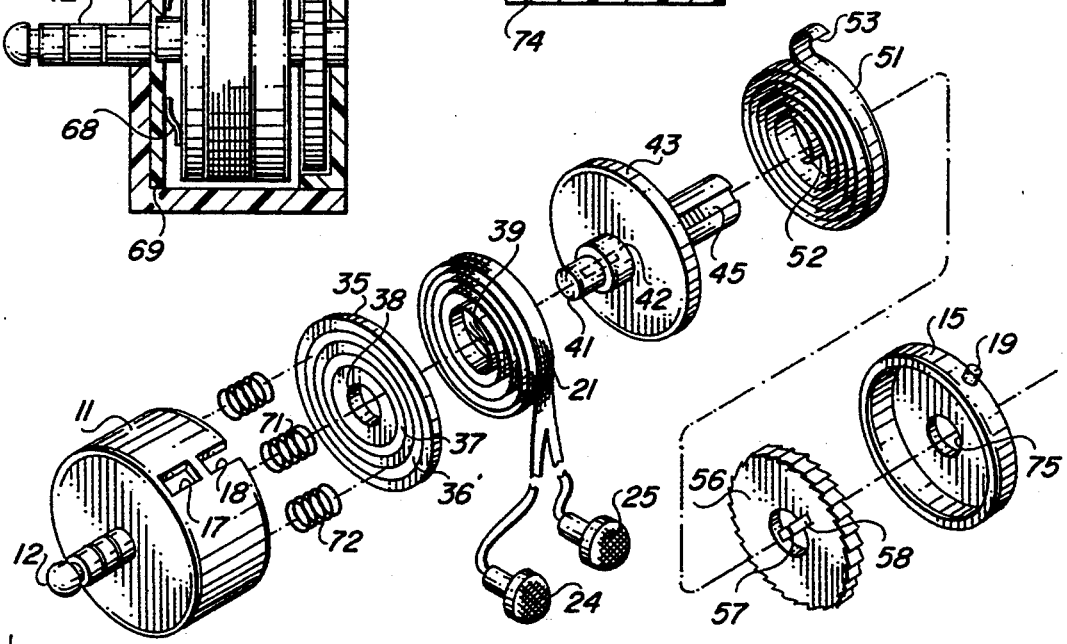
FIG. 2

CABLE TAKE-UP FOR EARPHONES

BACKGROUND OF THE INVENTION

This invention relates to earphones for portable electronic entertainment devices and, in particular, to a cable take-up for earphones.

Entertainment electronics has come full circle since the early days of radio when headphones were required in order to hear the signal plucked from the ether by a crystal detector. Later, vacuum tubes provided sufficient amplification to drive "loudspeakers", permitting several people to listen to the same radio simultaneously. The quest for fidelity, nearly attained with digital audio, has sent many consumers back to the headphone in order to avoid the considerable cost of high fidelity power amplifiers and speakers. The headphone has become reduced in size to two small earpieces fitting within each ear and capable of reproducing sound with remarkable fidelity.

As used herein, "headphone" and "earphone" mean any device placed in or on the human ear for producing audible sound. As used herein, "entertainment device" means any electronic entertainment apparatus, portable or fixed, such as radio, television, tape or compact disk (CD) player, electronic game, and multimedia computer.

Earphones typically include earpieces attached to one end of a four wire electrical cable having a plug on the other end. The cable is a source of inconvenience because the length of the cable is rarely the appropriate length for the particular use being made of the entertainment device. Also, there is no place to store the cable when the earphones are not in use. Typically, the cable is wrapped around the device or gathered into a ball and stuffed into a pocket. Either of these storage techniques frequently causes broken wires within the cable.

In the prior art, U.S. Pat. No. 4,942,617 (Boylan) discloses a take-up including a hollow case worn on a belt and a first cable connected between a plug and a first side of a commutator within the case. A second cable is connected between the commutator and a pair of earphones. The second cable is wound around a spring-loaded spool within the case for automatically retracting the cable when the force withdrawing the second cable is less than the tension from the spring.

The short first cable in the patented take-up severely limits the use of the earphones because it does not mechanically attach the case of the take-up to an entertainment device. Placing the entertainment device on a desk or shelf requires unplugging the earphone or removing the take-up from the belt and leaving it dangling from the device. Furthermore, the constant tension on the cable can be an annoyance, even if the entertainment device is also attached to the belt of the listener.

In view of the foregoing, it is therefor an object of the invention to provide a cable take-up which electrically and mechanically attaches to an entertainment device.

It is another object of the invention to provide a cable take-up which permits the cable to slacken when withdrawn to its desired length.

It is a further object of the invention to provide a cable take-up which has a durable cable for many cycles of extension and retraction.

SUMMARY OF THE INVENTION

The foregoing objects are achieved by the invention in which a cable take-up includes a cylindrical case and a plug mechanically attached to the case and extending axially from the case, within the case, a cable is wound onto a rotating spool biased by a spring to retract the cable. A ratchet prevents the cable from retracting and a release for the ratchet is accessible from outside of the case. The cable preferably is a flat ribbon of Kevlar® plastic having the wires embedded therein. One end of the cable is attached to earpieces and the other end of the cable is attached to the plug through a commutator. The commutator includes a first disk having resilient, conductive contacts connected to the plug and a second, rotating disk having concentric, conductive stripes connected to the cable and rubbing on the conductive contacts. In a preferred embodiment of the invention, the first disk is an end wall of the cylinder.

BRIEF DESCRIPTION OF THE DRAWINGS

A more complete understanding of the invention can be obtained by considering the following detailed description in conjunction with the accompanying drawings, in which:

FIG. 1 illustrates a cable take-up constructed in accordance with a preferred embodiment of the invention;

FIG. 2 is an exploded, perspective view of a take-up constructed in accordance with a preferred embodiment of the invention;

FIG. 3 is a cross-sectional view of an assembled cable take-up;

FIG. 4 illustrates a pawl and ratchet assembly for controlling the retraction of a cable; and FIG. 5 is a cross-sectional view of an alternative embodiment of the invention; and FIG. 6 is a cross-sectional view of cable 21.

DETAILED DESCRIPTION OF THE INVENTION

FIG. 1 illustrates a cable take-up constructed in accordance with a preferred embodiment of the invention. Take-up 10 includes cylindrical case 11 having plug 12 extending from end wall 13 of case 11. The end of case 11 opposite wall 13 is enclosed by cap 15. As illustrated in FIG. 1, case 11 is a right circular cylinder having end wall 13 in a plane perpendicular to the axis of the cylinder and plug 12 extending parallel to the axis of case 11. Case 11 can be any aesthetically pleasing shape, so long as the internal mechanism (described in conjunction with FIG. 2) can fit and operate within the case. Plug 11 need not be perpendicular to end wall 13 and need not be centrally located. It is required, in accordance with the invention, that plug 12 be mechanically attached to case 11.

Case 11 includes holes 17 and 18 and cap 15 includes button 19. Hole 17 is a rectangular hole in the side wall of case 11 and provides clearance for cable 21, which extends through hole 17 and terminates in earpieces 24 and 25. Cable 21 is preferably a thin, flat ribbon made from Kevlar® plastic having several wires embedded therein. Kevlar® plastic is an aramid fiber reinforced plastic that is pliable but durable. Such cable (ribbon with imbedded wires) is available from Preco New Products, Boise, Id.

The number and gauge of the wires is determined by the particular application. For example, for stereo headphones a minimum of three, 22 gauge wires is used for connection to earpieces 24 and 25. Connection to the earpieces can be simplified somewhat by using four wires and joining the inner ends of two of the wires to a common ground. The inner end of cable 21 is wound on a spool which can rotate within case 11 and the spool is biased by a spring to retract cable 21 into case 11.

FIG. 2 illustrates a take-up constructed in accordance with a preferred embodiment of the invention. In FIG. 2, take-up 10 includes case 11 as described above, within case 11, commutator 35 includes a plastic disk having concentric, conductive stripes, such as stripes 36 and 37, formed on one major surface thereof. Inner ends 39 of cable 21 are electrically connected to the conductive stripes and the disk rotates as the cable extends or retracts.

FIG. 3 is a cross-section of an assembled cable take-up. Extending from the inside of end wall 13 are a plurality of springs, such as springs 71 and 72, having a radial spacing corresponding to the radii of conductive stripes 36 and 37 (FIG. 2). Springs 71 and 72 are connected to different portions of the plug, which is typically a stereo phono plug. As the commutator rotates, the springs make sliding contact with the conductive stripes, electrically connecting the earpieces to the plug by way of wires in plate 74.

In FIG. 2, commutator 35 includes central hole 38 which fits over the outer end of spindle 41 but does not fit over collar 42. Disk 43 is attached to spindle 41 and is preferably made in a single piece with spindle 41 and collar 42. When commutator 35 is in place on spindle 41, commutator 35 is spaced from disk 43 by the height of collar 42. The height of collar 42 slightly exceeds the width of cable 21 and cable 21 winds around collar 42 as spindle 41 rotates. Disk 43, commutator 35, and collar 42 together are a spool for holding cable 21.

Spindle 41 fits within hole 73 in plate 74. Hole 73 is preferably a blind hole for locating spindle 41 both radially and longitudinally. Similarly, hole 75 in cap 15 is preferably a blind hole for locating spindle 41 radially and longitudinally.

As illustrated in FIG. 2, cable 21 is wound clockwise about spindle 41 and spindle 41 is biased to rotate in a counterclockwise direction by spring 51. Spring 51 can be any suitable coiled spring for providing an appropriate force on spindle 41 for retracting cable 21. In a preferred embodiment of the invention, spring 51 is a flat steel spring such as used in tape measures. Inner end 52 of spring 51 engages slot 45 in spindle 41. End 53 of spring 51 hooks onto hole 18 in case 11. If preferred, end 53 could hook onto an internal feature of case 11, thereby providing a smoother exterior.

As thus constructed, cable 21 is subjected to a continuous tension by spring 51. A ratchet and pawl mechanism in take-up 10 permits cable 21 to be withdrawn to a desired length and go slack. Specifically, ratchet gear 56 is coupled to spindle 41 by way of key 57 engaging slot 45 and keyway 58. The periphery of gear 56 is serrated or toothed for engaging a pawl as illustrated in FIG. 4. In FIG. 4, case 11 includes pivot 61 attached to the inside of the case and pawl 62 is attached at approximately its midpoint to pivot 61. Pawl 62 is biased away from case 11 by spring 63 for engaging a tooth on gear 56, such as tooth 64. Button 19 extends through case 11 to the opposite end of pawl 62 for moving the head of pawl 62 away from tooth 64, thereby releasing gear 56.

The ratchet and pawl mechanism provides a one-way restriction on the motion of cable 21, enabling cable 21 it be withdrawn from case 11 but preventing cable 21 from being retracted into case 11. Other mechanisms for controlling cable 21 could be used instead, such as a cam or friction brake engaging cable 21. An advantage of the ratchet and pawl is that the cable can be further withdrawn from case 11 if a listener should accidentally move further away from an entertainment device. With a cam or brake mechanism, cable 21 is jammed in place and such movement is likely to pull the earpieces out of the listener's ears or pull plug 12 out of the entertainment device. Thus, a ratchet and pawl, or other one-way mechanism, is preferred.

FIG. 5 illustrates an alternative embodiment of the invention in which leaf springs, such as springs 67 and 68, are used in place of coil springs for sliding contact with the conductive tracks on the commutator. The leaf springs are attached to plate 69 and electrically connected to plug 12.

FIG. 6 illustrates a cross-section of cable 21. Cable 21 preferably includes ribbon 75 of Kevlar® or other strong plastic having a plurality of wires, such as wire 76, embedded therein. The number and positioning of the wires is not critical and the wires are preferably uniformly spaced within the Kevlar® matrix.

The invention thus provides a cable take-up which electrically and mechanically attaches to an entertainment device and permits the cable to slacken when withdrawn to its desired length.

Having thus described the invention, it will be apparent to those of skill in the art that various modifications can be made within the scope of the invention. Instead of a separate key for locking ratchet gear 56 to spindle 41, a suitable key can be formed as an integral part of spindle 41. While described in a preferred embodiment as a take-up for the cable attached to earphones for an entertainment device, the invention can be used for other applications, such as an audio extension cord. As previously noted, any one-way restriction on the cable can be used. An alternative mechanism is a pair of cams on opposite sides of the cable and pivoted to move together as the cable is retracted, thereby jamming the cable therebetween. The cable is released by moving one of the cams away from the cable, e.g. by extending the cable.

I claim:

1. A cable take-up for connecting headphones to an entertainment device, said take-up comprising:

a spindle having a predetermined length between two ends;

a hollow case having two ends and a hole in each of said ends for receiving said spindle and radially locating said spindle;

said spindle including a collar and a disk attached to said spindle between the ends of said spindle;

a commutator mounted on said spindle adjacent said collar and spaced from said disk by said collar;

a flat cable including at least two electrical wires, said cable wound around said collar between said commutator and said disk, wherein said cable is electrically connected to said commutator;

a spring attached to said spindle and to said case for rotating said spindle in a first direction to cause said cable to wind onto said spindle, said spring wound on said spindle on the opposite side of said disk from said cable;

an electrical plug mechanically connected to said case and electrically connected to said commutator, said electrical plug being adapted to fit said entertainment device.

2. The cable take-up as set forth in claim 1 wherein said cable includes a Kevlar ® ribbon and said wires are embedded in said ribbon.

3. The cable take-up as set forth in claim 1 wherein said collar and disk are an integral part of said spindle.

4. The cable take-up as set forth in claim 1 and further comprising:

means for preventing said spindle from rotating in said first direction and permitting said spindle to rotate in a second direction, opposite to said first direction.

5. The cable take-up as set forth in claim 1 and further comprising:

at least one earphone electrically connected to said wires.

* * * * *